United States Patent [19]

Nelson

[11] 4,379,561

[45] Apr. 12, 1983

[54] WELL PACKER

[75] Inventor: Hugh D. Nelson, Sydney, Australia

[73] Assignee: Mono Pumps Limited, Manchester, England

[21] Appl. No.: 343,568

[22] Filed: Jan. 28, 1982

[30] Foreign Application Priority Data

Jan. 29, 1981 [GB] United Kingdom ..... 8102742

[51] Int. Cl.[3] ..... E21B 23/00; E21B 43/00

[52] U.S. Cl. ..... 277/237 R; 116/106; 116/206

[58] Field of Search ..... 166/206, 207, 208, 106, 166/105; 418/48; 277/116.6, 237 R

[56] References Cited

U.S. PATENT DOCUMENTS

| | | | |
|---|---|---|---|
| 3,891,031 | 6/1975 | Ortiz | 166/106 |
| 4,142,371 | 3/1979 | Mayfield et al. | 277/237 R |
| 4,212,352 | 7/1980 | Upton | 166/206 |

FOREIGN PATENT DOCUMENTS

| | | | |
|---|---|---|---|
| 676042 | 12/1963 | Canada | 166/206 |
| 893623 | 4/1962 | United Kingdom | 166/206 |
| 1567886 | 5/1980 | United Kingdom . | |
| 729632 | 12/1974 | U.S.S.R. | 166/106 |

*Primary Examiner*—Robert I. Smith

*Attorney, Agent, or Firm*—Fleit, Jacobson & Cohn

[57] ABSTRACT

A well packer, in particular for a bore hole pump, comprises a packer sleeve having a tapered external surface surrounded by a collet ring which has a tapered internal surface. The collet ring is of resilient material and can be stressed to a smaller diameter configuration in which two adjacent collet-holding fingers of a removable holding mechanism engage in two now closely spaced holes of the collet ring to hold the collet ring in engagement with the smaller diameter lower part of the tapered external surface of the packer sleeve. The collet-holding mechanism can be operated to rotate a cam link of the mechanism to withdraw a safety link and to retract the fingers radially inwardly to release the collet allowing it to spring radially outwardly against a well casing in which the packer sleeve and the collet ring have been positioned by lowering down the well casing.

20 Claims, 9 Drawing Figures

WELL PACKER

The present invention relates to a well packer, and in particular to a form of well packer designed for use with the bore hole pump disclosed in our British Patent Specification No. 1,567,886. Such a pump is used for pumping water from wells.

Well packers have been used in the hydrocarbon drilling industry for many years, but are not commonly used in water wells. It is intended that the pump disclosed in our said British Patent Specification No. 1,567,886 should be capable of being positioned not simply at one predetermined location, e.g. the bottom, of a well by attachment of a special casing portion as the bottom member of the bore hole lining pipe, but instead that the pump should be capable of being positioned anywhere in an existing clad well by means of the subsequently installed packer which forms the subject of the present application.

In accordance with the present invention we provide a well packer comprising a packer sleeve and means to lock the sleeve in a bore hole, characterised in that the packer sleeve has a tapered external surface portion; and in that the means to lock the sleeve comprise an annular collet having an internal surface of a taper able to cooperate with that of the external tapered surface portion of the packer sleeve and having an external surface capable of frictionally engaging a well casing pipe having a diameter larger than the external diameter of the packer sleeve, said collet being resiliently deformable from a larger diameter relaxed configuration to a smaller diameter stressed configuration in which it engages the tapered external surface portion of the packer sleeve; means for holding said collet in said smaller diameter stressed configuration while engaged around the tapered external surface portion of the packer sleeve; and means operable from a remote location to release said collet from its stressed configuration to spring radially outwardly towards its released configuration.

The means for releasing the collet-holding means may, for example, be a cam-operated mechanism responsive to ascent of the packer sleeve up the well, or a mechanism driven by means of a gravity-biased trigger which is held off by supporting the triggering weight until the well packer has reached the desired level in the well whereupon release of the triggering weight operates the collet-releasing trigger action. Any other remotely-operated means may be used.

By use of co-operating tapers for the external tapered surface portion of the packer sleeve and the internal tapered surface portion of the collet, it is possible to ensure that the packer sleeve is self-locking in place, particularly when it carries the weight of the pump and the hydrostatic pressure of the pumped fluid, but can nevertheless be raised from the well using a fishing tool to raise the packer sleeve and break the locking action of the tapers.

In order that the present invention may more readily be understood the following description is given, merely by way of example, with reference to the accompanying drawings in which.

Figure 2:
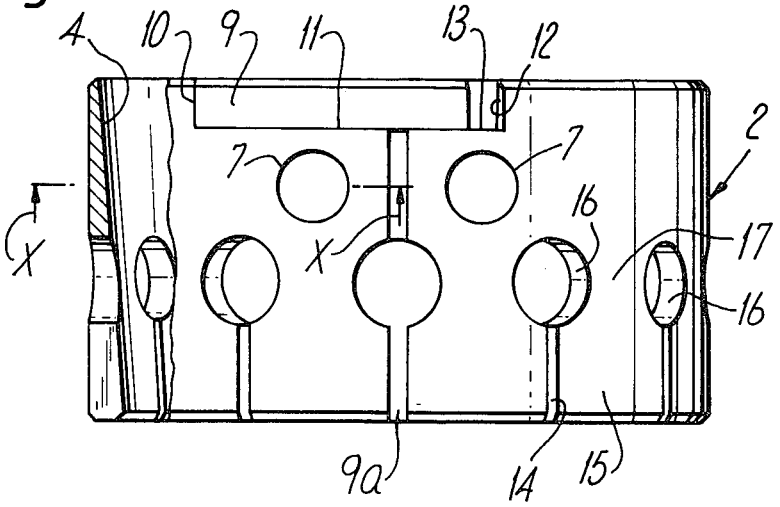
FIG. 2 shows an elevation of a diametral section of the collet ring for use with the packer sleeve of FIG. 1, the left hand part of this Figure being in part-sectional form.
Figure 3A:
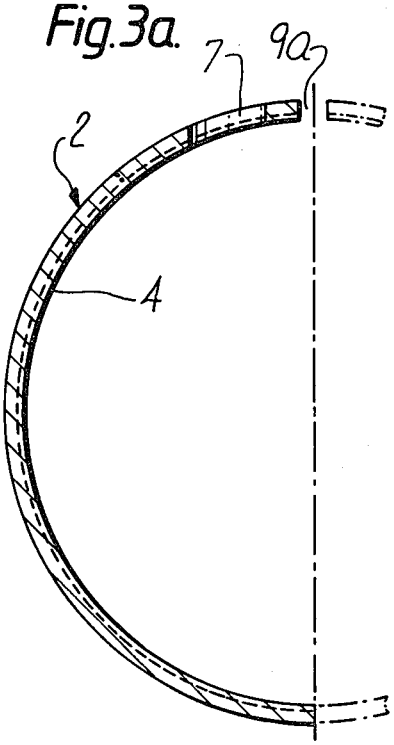
Figure 3B:
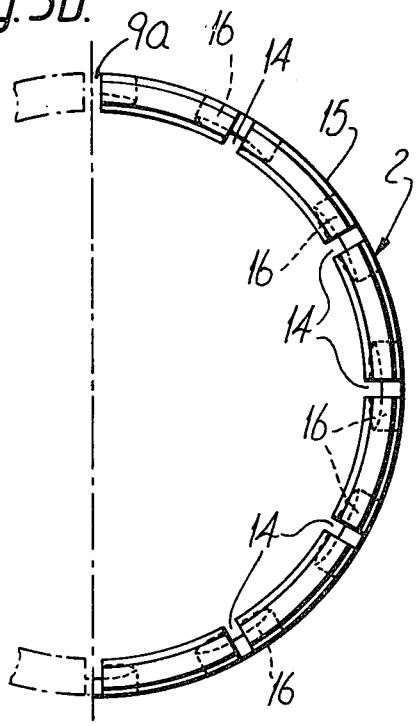
Figure 4:
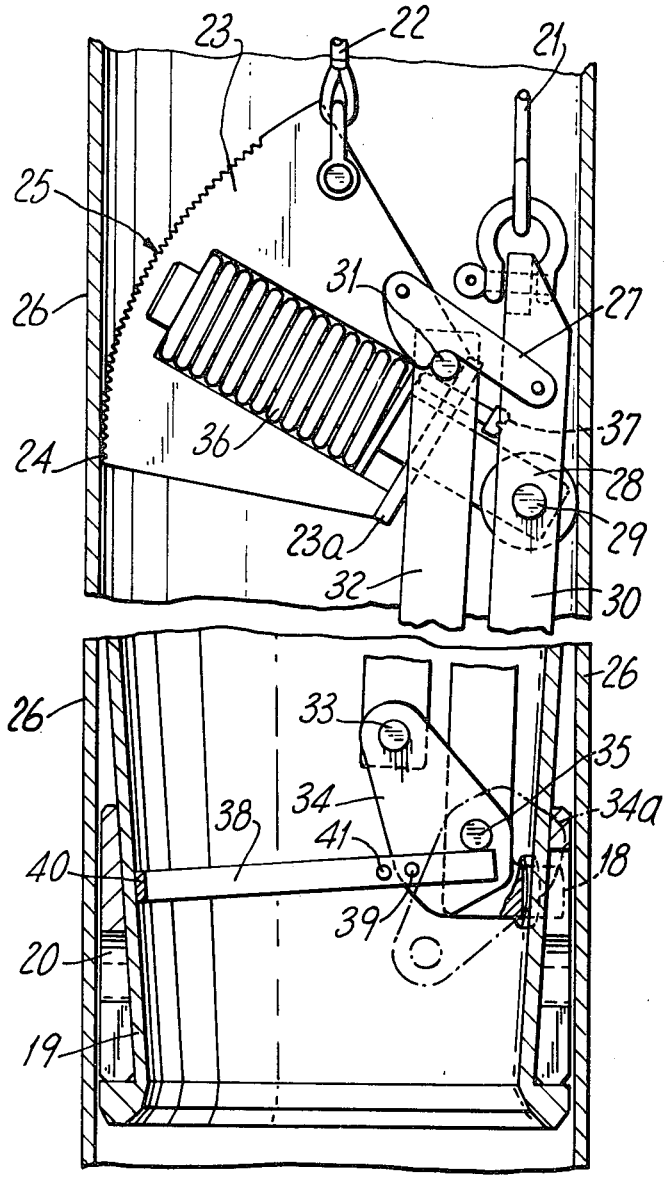
Figure 5:
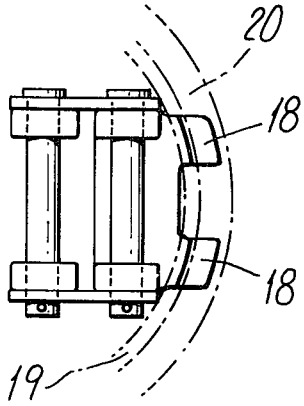
Figure 8:
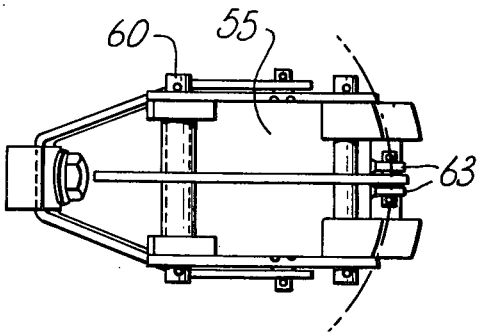
Figure 6:
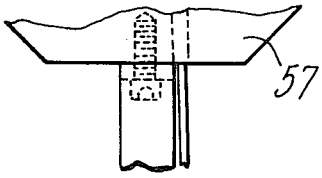
Figure 6:
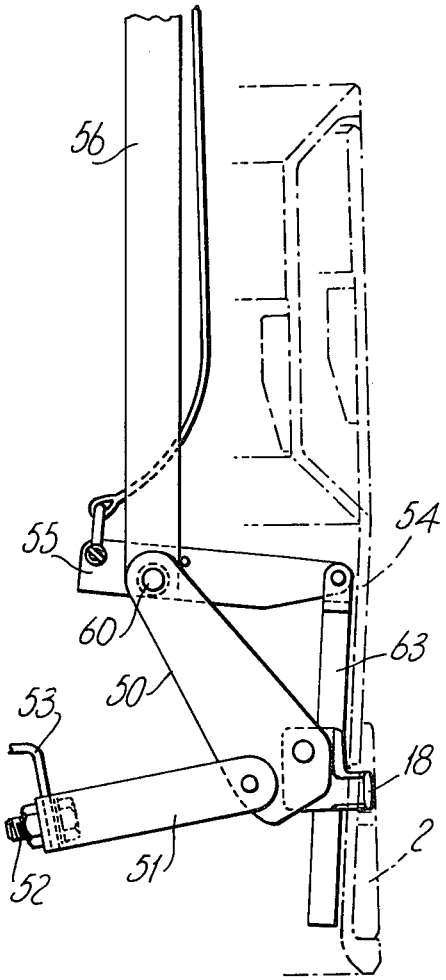
Figure 7:
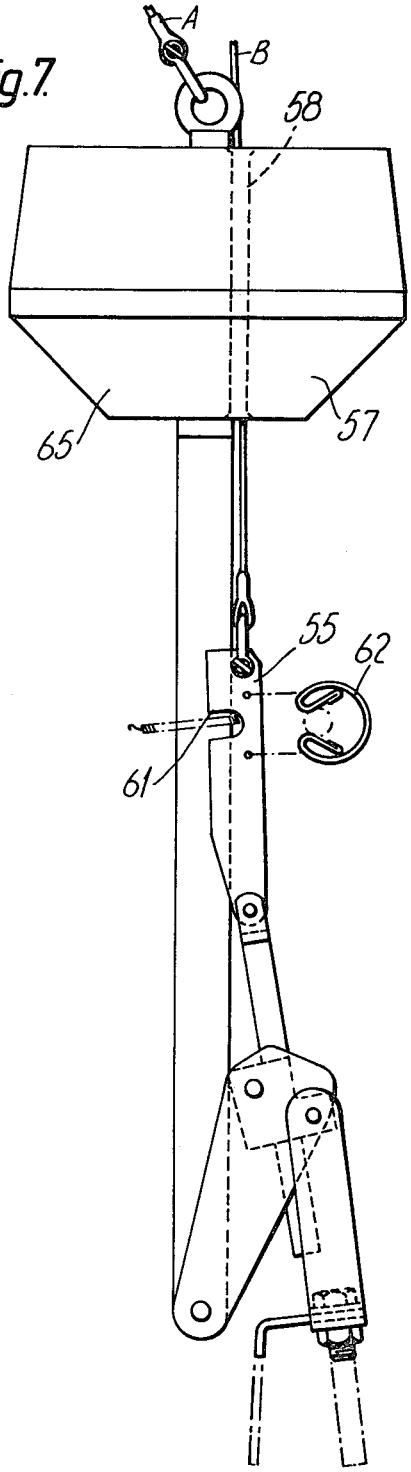

FIG. 3*a* shows one half of a transverse section taken on the line X—X of FIG. 2;

FIG. 3*b* shows one half of an end elevation of the collet ring of FIG. 2;

FIG. 4 shows a side elevational view of a first embodiment of collet ring-releasing trigger mechanism (of cam-operated form), in the "trigger set" condition;

FIG. 5 is an underneath plan view of the trigger mechanism of FIG. 4, but showing only the pivots of the cam links and the collet-holding fingers;

FIG. 6 is a side elevational view showing a second embodiment of collet-releasing trigger mechanism (using a gravity-triggered action), shown in the "trigger set" configuration;

FIG. 7 is a view similar to FIG. 6 but showing the mechanism in the "triggered" configuration ready for recovery from the well; and FIG. 8 is an underneath plan view of the gravity-triggered mechanism of FIGS. 6 and 7, in the "trigger set" configuration shown in FIG. 6.

Figure 1:
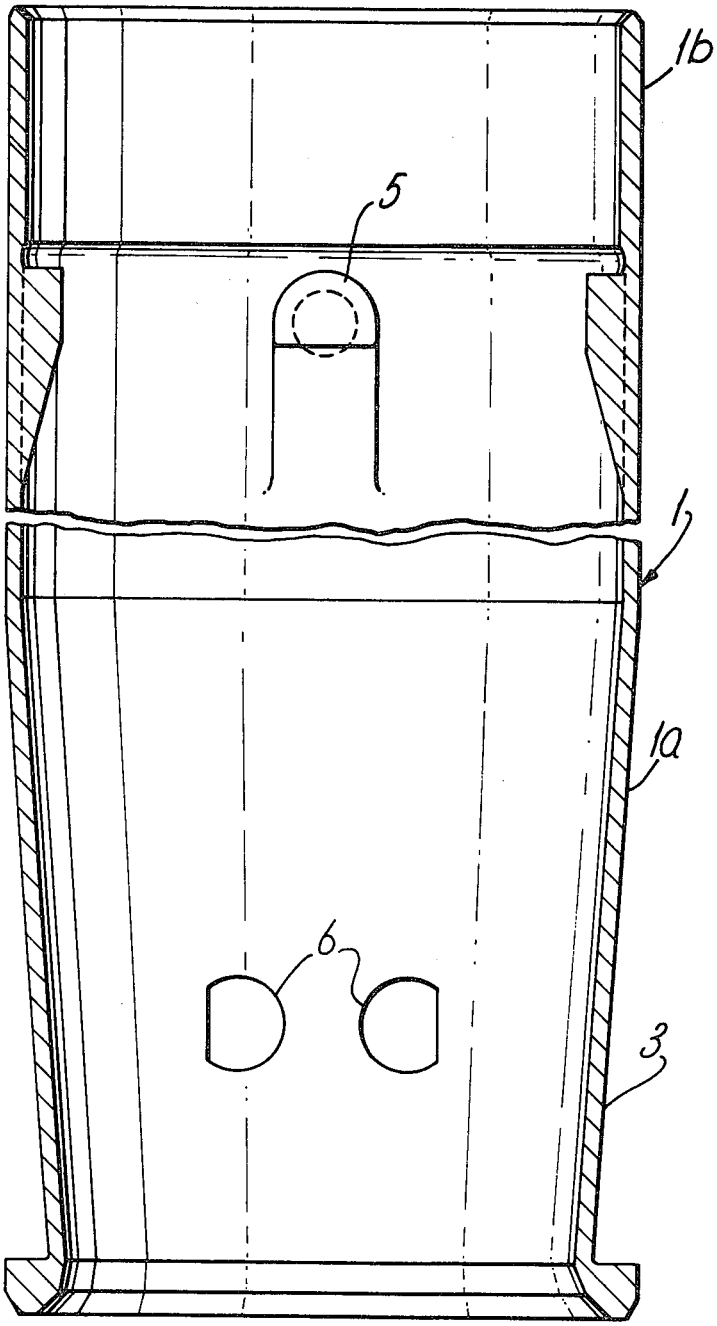
FIG. 1 is a longitudinal sectional view of the packer sleeve of a packer in accordance with the present invention.

The packer in accordance with the present invention comprises a packer sleeve 1 of S.G. iron, shown in FIG. 1, and a spring steel collet ring 2, shown in FIGS. 2, 3*a* and 3*b*.

As shown in FIG. 1, the lower part 1*a* of the packer sleeve 1 has a downwardly convergent taper defining an external downwardly convergent tapered surface portion 3 having a taper angle of 4°, and intended to cooperate with the corresponding internal taper surface 4 of the collet ring 2, again having a taper of 4°. At the bottom of the tapered surface portion 3 is an outwardly extending flange to retain a collet ring (to be described with reference to FIGS. 2, 3*a* and 3*b*) thereon in the event of premature release of the collet ring.

As the packer sleeve 1 is lowered down the well to a desired level, the collet ring 2 is held in a stressed condition so as to be confined to contact the tapered external surface portion 3 of the packer sleeve and so as to have no portion of the collet ring extending radially outwardly beyond the vertical projection of the perimeter of the upper cylindrical portion 1*b* of the packer sleeve 1. Thus the well packer comprising the packer sleeve 1 with the collet ring 2 thereon will be able to descend freely slidably down the well casing (not shown in FIG. 1 but referenced 26 in FIG. 4) and the correct level will be reached with the minimum of drag between the well packer and the well casing.

Once the packer sleeve 1 has reached the desired level, a collet ring trigger mechanism, two embodiments of which are to be described hereinafter with reference to FIGS. 4 and 5 on the one hand, and to FIGS. 6, 7 and 8 on the other hand, is operated to release the spring collet ring 2 which snaps radially outwardly to exert a spring clinging action on the internal surface of the well casing. In so doing, the collet ring 2 will withdraw its radially inward tapered surface 4 from the external tapered surface portion 3 of the packer sleeve and it is then necessary to lower the packer sleeve 1 slightly in order to re-engage the tapers whereupon further lowering will simply jam the internal tapered surface 4 of the collet ring 2 firmly into engagement with the external tapered surface portion 3 of the packer sleeve 1 and will lock the packer sleeve 1 in position (the engagement of the tapers being assisted by the fact that the collet ring 2 is sprung into frictional engagement with the well casing).

As described in our British Patent Specification No. 1,567,886, the bore hole pump which is to be engaged in the packer ring 1 carries recesses to mate with inwardly extending lugs 5 of the packer sleeve 1, in order to resist the rotation torque of the pump stator when the pump rotor is driven.

It will of course be understood that many known bore hole pumps avoid the need for any torque-reaction engagement with the well casing by virtue of the provision of a separate torque-reaction pipe connected to the pump casing. This torque-reaction pipe may either be in the form of a separate delivery pipe which is lowered down the well together with the pump and must therefore be recovered when the pump is pulled out for maintenance or repair, or may comprise a stationary sheath co-axially around and closely spaced from the rotatable drive shaft, again requiring recovery from the well in the event of pump maintenance or repair.

Using the packer in accordance with the present invention ensures that the pump can be recovered simply by lifting, using the pump rotor drive shaft as the lifting means and can, when desired, be returned to engagement with the lugs 5 of the packer.

It is advantageous if the tapered surface 4 of the collet ring 2 and/or the external tapered surface portion 3 is rough-machined to have an undulating surface in the form of a helical screw-thread arrangement so that if the packer sleeve 1 should rotate when the turbine is operated, the fact that the inside of the collet ring 2 has this crude screw-thread on its surface will result in downward movement of the packer sleeve 1 so as more firmly to press the collet ring 2 outwardly into engagement with the interior of the well casing and thereby more securely to anchor the packer sleeve 1 in position. This assumes, of course, that the thread hand is such that rotation of the packer sleeve in the same direction as that of the drive shaft and pump rotor, in use of the pump, will induce downward movement of the packer sleeve 1 relative to the collet ring 2.

As shown in the lower part 1*a* of FIG. 1, the packer sleeve 1 is cast with two holes 6 through which holding fingers (18 in FIG. 5) of the collet ring trigger mechanism can protrude radially outwardly so as to engage in corresponding holes 7 (FIG. 2) in the collet ring 2.

The finger-receiving holes 7 will, as shown in the relaxed configuration of the collet ring 2 in FIG. 2, normally be spaced apart more widely than the corresponding trigger-receiving holes 6 of the lower portion 1*a* of the packer sleeve 1. Therefore, in order to permit the collet-holding fingers to engage the finger-receiving holes 7 of the collet ring 2 as they project radially outwardly through the holes 6 of the packer sleeve 1 it is necessary for the collet ring 2 to be compressed circumferentially (using a suitable strap-or band-clamp, not shown) to bring its two end faces 8 at the slit 9*a* thereof closer together.

As shown in FIG. 2, the collet ring 2 is provided with a segment 9 which is welded in place, along an axial line 10 and a circumferential line 11 of the collet ring, so that this segment 9 projects from the left hand side of the longitudinal slit 9*a* at the upper end of the collet ring 2 to engage slidably with a circumferentially extending wall 13 of an L-shaped recess of the collet ring 2. This recess is bounded by the abovementioned circumferential face 13 and an axial face 12 of the collet ring. The segment 9 assists in ensuring a sealing action to prevent undue loss of hydrostatic pressure between the well casing on the one hand and the external surface of the packer sleeve 1 on the other hand. The purpose of providing a separately formed segment and welding it in place is that this simplifies machining of the spring steel collet ring 2.

As shown in FIG. 2, the narrower wall portion at the upper axial end of the collet ring 2 is continuous, except for the slit 9*a* which is of course bridged by the above-described segment 9. On the other hand, the thicker wall portion at the lower axial end of the collet ring 2, as viewed in FIG. 2, is perforated by a series of slots 14 which define between them tongues 15. Furthermore, the upper end of each of the slots 14 opens into a circular hole 16 whose radius is at least as great as the width of the slot 14, so that between any two adjacent holes 16 is a bridge 17 of spring steel material which permits the tongue 15 to deflect radially inwardly and outwardly. This ensures that the lower part of the exterior of the collet ring 2 is capable of conforming to the interior of a well casing which may, by the time the collet ring 2 and packer sleeve 1 are subsequently lowered into position, have become encrusted and present an irregular internal surface.

The unbroken upper thin wall section provides a continuous "C" spring which acts like a circlip to hold the exterior of the collet ring 2 in engagement with the interior (26 in FIG. 4) of the well casing, while the slotted lower portion defining the separate tongues 15 is nevertheless able to conform to irregular well casings. The slots 14 and holes 16 also assist in reducing the stiffness of the collet ring to that of the C spring upper end.

Any suitable means of releasing the collet ring 2 from its peripherally inwardly stressed configuration to its larger diameter relieved configuration can be provided.

The present application envisages two particular forms of triggering mechanism as being particularly useful. The first of these is illustrated in FIGS. 4 and 5 where FIG. 4 shows a side elevational view of the mechanism in its "trigger set" configuration and FIG. 5 shows an underneath plan view illustrating the two collet ring-holding fingers 18 and the interior 19 of the lower tapered portion 1*a* of the packer sleeve 1 and the internal surfaces 20 of the collet ring 2.

During lowering of the packer sleeve 1 with its collet ring 2 held in the smaller diameter "stressed" configuration by means of the two collet ring-holding teeth 18 of the triggering mchanism, the weight of the entire assembly comprising the packer sleeve 1, the collet ring 2, and the triggering mechanism is taken on the lowering line 21.

FIG. 4 shows an optional additional line 22 which may, if desired, be used as the lowering line which holds a drive cam plate 23 of the trigger mechanism in its raised "safety" configuration where the end 24 of an arcuate serrated outer surface 25 of the cam plate 23 is just in contact with the interior of the well casing 26 above the packer sleeve 1. For obvious reasons, extra safety is imparted when, during lowering, the weight of the entire assembly is taken by the second lowering line 22 directly operating on the cam plate 23.

FIG. 4 also shows an optional pivotal latch link 27 which, in the configuration shown in FIG. 4, holds the cam plate 23 against anti-clockwise movement and clear of the well casing 26. It is this anti-clockwise movement of the cam plate 23 which will be necessary in order to trigger the release of the collet ring-holding fingers 18. The latch link can be released by an upward pull (using the line 22 connected to the hole at the free end of the latch link 27 or any other suitable means) from the surface at the top of the well.

It will of course be understood that it is most unlikely for the latch link 27 and the additional lowering line 22 to be used on the same triggering mechanism.

The cam plate 23 is slidable with respect to a mounting arm 28 which itself is mounted on a pivot 29 with respect to a pair of main links 30 only one of which can be seen in FIG. 4. A pair of operating links 32 is pivoted at its top end (on a pin 31) to the cam plate 23 and has, at its bottom end, a pivot pin 33 articulating it to a pair of cam links 34 which has another pivot 35 articulating it to the pair of main links 30.

The sliding movement of the cam plate 23 with respect to its mounting arm 28 is biased by means of a helical compression spring 36 pressing the cam plate 23 radially outwardly with respect to the support arm 28 until a stop screw 37 on a stop plate portion 23*a* of the cam plate 23 is in engagement with a shoulder on the mounting arm 28, this shoulder also providing an abutment for one end of the compression spring 36. Adjustment of the screw 37 changes the radially outward position of the travel of the stop plate 23 along the mounting arm 28.

The cam links 34 are each in the form of a cam which has a toe 34*a* which, in the "trigger set" configuration of FIG. 4, lies clear of the internal surface 19 (FIG. 5) of the packer sleeve tapered portion 1*a*. However, lowering of the pivot pin 33, due to anti-clockwise rotation of the cam plate 23 and its mounting arm 28, will rotate the cam links 34 in the anti-clockwise direction to bring the toes 34*a* into engagement with the internal surface 19 of the packer sleeve tapered portion 1*a* and further rotation will pull the pivot pin 35 inwardly towards the centre of curvature of the packer sleeve 1, withdrawing the fingers 18 from the finger-receiving holes 7 of the collet ring 2 until they have retracted to release the collet ring 2 to allow it to spring radially outwardly into engagement with the well casing 26.

As shown at the bottom of FIG. 4, the triggering mechanism is provided with a safety link 38 which is pivoted at 39 to the cam links 34 and has an outer end shoe 40 normally engaging the interior of the opposite side of the interior of the packer sleeve portion 1*a* to hold the collet ring-holding fingers 18 firmly in their receiving holes 6 of the packer sleeve 1. Initial rotation of the cam links 34 drives a stud 41 of the safety link 38 downwardly to release the end shoe 40 from its position of engagement with the interior of the packer sleeve 1 so that only after the drive cam plate 23 has begun its anti-clockwise rotation is the safety link 38 disengaged. This now frees the fingers 18 to be retracted upon further rotation of the cam links 34.

The cam surface 25 of the drive cam plate 23 is serrated, as described above, and has a varying radius of curvature from the portion 24 where the radius of curvature is tightest to the opposite end of the cam surface 25 where the curvature of the cam surface is greatest. This ensures a progressively increasing engagement action of the cam surface 25 with the interior of the well casing 26 as the entire triggering mechanism is lifted using line 21 after off-loading of the line 22 (if the line 22 has been fitted) or after release of the latch link 27 if this has instead been used as the safety mechanism.

As a result of the operations described above, slight raising of the packer sleeve 1 in the well casing 26 will induce simultaneous anti-clockwise rotation of the mounting arm 28 carrying the cam plate 23, and also radially inward movement of the cam plate 23 along the mounting arm 28, this radial movement being resisted by the compression spring 36. However, this anti-clockwise motion will first of all release the safety link 38 and secondly withdraw the collet ring-holding fingers 18 from the collet ring 2 to allow the collet ring to spring outwardly into engagement with the well casing 26, whereafter the packer sleeve 1 needs to be lowered slightly in order to engage the tapering surfaces for locking the packer sleeve 1 in place.

The gravity-triggered form of holding mechanism shown in FIGS. 6, 7 and 8 has a similar cam link pair 50 and safety link 51, except that in this case the safety link 51 is provided with an adjustable end comprising a removable threaded stud 52 and an exchangeable bracket 53 so that the end of the safety link 51 can be adjusted to suit different diameters of packer sleeve 1.

FIG. 6 is also interesting in that it shows an alternative form of packer sleeve 54 which provides the seating for a 6 inch (150 mm) pump but has its external tapered surfaces matched to an 8 inch (204 mm) well casing diameter.

Also, in FIG. 6, the latch link 55 is at the bottom end of the main links 56 and is directly connected to a release line B.

The top end of the pair of main links 56 carries the gravity-triggering weight 57 which has a passage 58 to allow the latch release line B to pass therethrough. A main lowering line A (FIG. 7), is attached to an eyebolt 59 at the top of the triggering weight 57 and is the line which will normally be used for lowering the assembly of the packer sleeve 1, the collet ring 2 and the collet ring-holding mechanism down the well casing.

FIG. 6 shows, in broken lines, the position of the collet ring 2 at the bottom (the narrowest diameter end) of the tapered external surface portion of the packer sleeve 54. It is clear from the illustrations of FIGS. 6 and 7, and the above description of the operation of the cam-triggered mechanism shown in FIGS. 4 and 5, that once the assembly of the packer sleeve 1, the collet ring 2 and the collet ring-holding mechanism has been lowered to the appropriate level by means of line A (without any tension on line B for fear of releasing the latch link 55) then increasing the tension on line B pulls the latch link 55 for rotation in the clockwise direction, thereby releasing the pivot pin 60 of the cam links 50 from the constraint of the U-shaped notch 61 (FIG. 7) of the latch link 55 and allowing it to move downwardly and leftwardly as the cam links 50 rotate in the anti-clockwise sense to first of all withdraw the safety link 51 from contact with the opposite side of the packer sleeve interior and secondly to withdraw the collet ring-holding fingers 18 from the holes 7 in the collet ring 2.

As shown in FIG. 7, a latch safety clip spring 62 is provided to hold the latch 55 securely in the "trigger set" configuration until the packer sleeve 1, collet ring 2 and collet ring-holding mechanism have been correctly positioned in the top of the bore hole and the lines A and B are in the correct configuration to begin lowering.

A suitable safety clip is also envisaged for use with the latch link 27 of FIG. 4, and the latch pin 31.

Once the latch link 55 has rotated in the clockwise direction the triangular assembly of the latch link 55, the pair of cam links 50 and the pair of actuating links 63, forming a rigid frame, is released by suddenly releasing the tension in line A and the two-cam links 50 rotate in the anti-clockwise direction as the trigger weight 57 descends. First of all the safety link 51 is withdrawn and then, shortly afterwards, the collet ring-holding fingers 18 are withdrawn to release the collet onto the interior of the well casing.

Although not illustrated in the drawings, there will of course be a further component of the apparatus, namely the abovementioned tensioning clamp (not shown) which is a band-clamp or strap-clamp placed around the collet ring 2 once the collet ring has itself been placed in the position shown in FIG. 6, and then tightened in order to pull the collet ring 2 to its smaller diameter configuration in which the two finger-receiving holes 7 are both in register with the corresponding finger-receiving holes 6 of the packer sleeve 1. Then the trigger weight 57 is lifted to the FIG. 6 configuration to allow the latch link 55 to be positioned with its recess 61 encompassing the pivot pin 60, and then the safety link 51 is pivoted in the clockwise direction to bring its end into engagement with the interior of the packer sleeve 1 opposite the two holes 6 thereof. Then the latch spring 62 must be placed in position so that the entire assembly in its "trigger set" configuration can then be transported to the well head and connected to the appropriate lifting lines ready for insertion into the well head and removal of the latch safety clip spring 62 to arm the mechanism.

A particularly convenient feature of the embodiment shown in FIGS. 6 to 8 is that the diameter of the triggering weight 57 is substantially the same as that of the well casing so that, after the cam links 50 and the safety link 55 have dropped into the "triggered position" shown in FIG. 7, the radially outer portion of the frusto-conical lower surface 65 of the triggering weight 57 can be used to hammer home the packer sleeve 1 onto its collet ring 2 by repeatedly lifting the triggering weight 57 clear of the packer sleeve 54 and then dropping it onto the top of the sleeve. This will ensure a tight fit of the packer sleeve 1 in the well casing before the collet ring-holding mechanism is recovered and the pump lowered into position.

Although the above description of the arming process have only been given with reference to the embodiment of FIGS. 6, 7 and 8, an exactly analogous process is required to arm the mechanism of FIGS. 4 and 5.

It will readily be appreciated from the drawings, and from the above description, that the combination of the packer sleeve 1 with its sprung collet ring 2 provides a particularly convenient form of well packer intended for supporting a bore hole pump where the external diameter of the bore hole pump is not much less than the internal diameter of the well casing. When in situ, the combination of the thin-walled packer sleeve 1, together with its sprung collet ring 2, is devoid of any collet-releasing linkage since this is all recovered by pulling to the surface using line 21 of FIGS. 4 and 5 or using line B of FIG. 7.

Despite the fact that the packer sleeve 1 has a small diametral thickness to allow it to fit into the well casing 26 and to offer the minimum obstruction to the useful cross-sectional area in the well casing, the special design of the collet ring 2 as described with reference to FIGS. 2, 3*a* and 3*b* by which it has a series of tongues 15 at its lower part and a continuous "C" spring at its upper part allows it to accommodate a wide variation of pipe diameters (because of the wide tolerance on pipe manufacture) and also a wide variation of collet ring diameter as the collet ring travels up the tapered exterior of the lower part of the packer sleeve 1 upon engagement.

The particular value of 4° has been quoted in the above description for the taper angle. However, generally any suitable taper angle can be used. In particular, we prefer that the taper be in the range from 2° to 5°.

As mentioned above, there is a tendency for the hydrostatic pressure of the water above the turbine to leak down between the packer sleeve 1 and the well casing, but this is resisted by the design of the collet ring 2 with its welded segment 9, and may be further enhanced by the application of a suitable sealing compound (preferably one which could not induce slip between the well casing 26 and the collet ring 2) on the exterior of the collet ring, and possibly also a similar application of composition on the interior surface of the collet ring. It will of course be appreciated that the pump casing is provided with its own seal for example an O-ring seal to ensure that no such loss of pumped fluid can occur through a gap between the exterior of the pump casing and the interior surface of the seating defined by the packer sleeve 1.

I claim:

1. A well packer comprising: a packer sleeve means; means defining a tapered external surface portion of said packer sleeve; expansible annular collet means; means defining an internal surface to said collet means of a taper able to cooperate with that of the external tapered surface portion of the packer sleeve means; means defining an external surface of said collet means capable of frictionally engaging a well casing pipe having a diameter larger than the external diameter of the packer sleeve means; said expansible collet means being resiliently deformable from a relaxed first configuration in which it has a first diameter to a second configuration in which it has a diameter smaller than said first diameter and it engages the tapered external surface portion of the packer sleeve means; collet-holding means for holding said collet means in said second configuration while engaged around the tapered external surface portion of the packer sleeve means; and collet release means operable from a remote location to release said collet means from its said second configuration to spring radially outwardly towards its said first configuration.

2. A well packer according to claim 1, including means releasably connecting said collet-holding means to said packer sleeve means; and means for recovering said collet-holding means to a remote location.

3. A well packer according to claim 2, and including latch means for latching said collet-holding means to prevent its said operation from a remote location until after said latch means has been released.

4. A well packer according to claim 3, and including a safety clip associated with said latch means for installation once the releasable collet-holding means has been engaged with said collet means and for removal to arm the releasable collet-holding means once the packer is in its desired orientation for lowering down a bore hole well casing.

5. A well packer according to claim 1, wherein said collet means comprises a ring of resilient material provided with a longitudinally extending slit along one generatrix thereof and passing from the radially inward surface of the collet means, and means are provided adjacent the edges of said slit for engagement with said releasable collet-holding means.

6. A well packer according to claim 5, wherein said collet means has first and second ends; wherein said external surface portion of the collet means is cylindrical; wherein said internal tapered surface is frusto-conical and has a larger diameter end at said first end of the collet means and a smaller diameter end at said second end of said collet means; and wherein said collet means includes means at said second end of said collet means defining a plurality of longitudinally extending slots separating individual tongues of said collet means from one another.

7. A well packer according to claim 6, including means defining a plurality of holes in said collet means, each of said longitudinally extending slots terminating at its inner end in a respective one of said holes, and each said hole having a diameter larger than the width of said slots.

8. A well packer according to claim 6, wherein said first end of said collet means is continuous around its periphery, apart from said longitudinal slit permitting stressing of said collet means to its said second configuration.

9. A well packer according to claim 8, including (a) means defining a recess in said collet means at the end of said longitudinal slit disposed at said first end of the collet means, said recess communicating with one side of said longitudinal slit, and (b) a projection extending from the other side of said longitudinal slit and received slidably in said recess as the collet means is deformed between its said first and second configurations, whereby said projection assists in sealing said collet means against movement of liquid past the outside of said collet means in use of the well packer.

10. A well packer according to any one of claims 5 to 8, including means defining two holes in said collet means, each said hole being positioned on a respective side of said slit, and means defining two further holes in said packer sleeve means, said first mentioned holes being in register with said further holes in said second configuration of said collet means; and wherein said collet-holding means comprise a pair of collet-holding fingers movable radially inwardly and outwardly through said further holes in said packer sleeve to engage the said first mentioned holes in the collet means when the collet means is held in its said second configuration and to retract radially inwardly through the packer sleeve means to release the collet means upon actuation of said collet release means operatable from said remote location.

11. A well packer according to claim 10, wherein said collet release means comprise cam-operated means driving said collet-holding fingers to retract inwardly through the packer sleeve means, and said cam-operated means include a cam which has a pivot and a toe and is rotatable from a first position to a second position causing said toe of said cam to engage the radially inner surface of the packer sleeve means and to lever the pivot of said cam in a direction radially inwardly away from said packer sleeve, said collet-holding fingers being connected to said pivot for retraction radially inwardly as the cam pivot retracts radially inwardly of the packer sleeve means.

12. A well packer according to claim 11, and including a safety link engageable withh said cam on the one hand and with a part of the radially inner surface of said packer sleeve diametrically opposite the collet-holding fingers on the other hand, to prevent said collet-holding fingers from inadvertently withdrawing from the collet means while the collet means is in its second configuration, said cam and said safety link being effective to cooperate so that during the early part of finger-retracting rotation of the cam the safety link is first disengaged from said diametrically opposite part of the inner surface of said packer sleeve means.

13. A well packer according to any one of claims 2 to 9, wherein said collet-release means operatable from a remote location comprise a trigger weight which is supported from said remote location until such time as release of the collet means is required, whereupon the trigger weight is allowed to drop to trigger release of said collet means.

14. A well packer according to any one of claims 2 to 9, wherein said collet release means operatable from a remote location include a drive cam having a cam surface projecting radially outwardly beyond the external surface of said packer sleeve means for engagement with a well casing having an internal diameter slightly larger than that of said packer sleeve means, and positioned such that raising of said packer sleeve causes said cam surface of the drive cam to drag on the inner surface of the well casing and to rotate said drive cam to withdraw said collet-holding fingers from the collet means.

15. A well packer according to claim 14, wherein said drive cam comprises a pivotable mounting arm, a cam plate slidably carried by said mounting arm, and means biasing said cam plate for radially outward movement along said mounting arm, said cam surface being shaped such that as said mounting arm rotates said cam plate slides radially inwardly along said mounting arm.

16. A well packer according to claim 15, wherein said collet release means operable from a remote location comprise a lifting line engageable with said drive cam and holding it in a position at an opposite end of its travel from that at which it has effected withdrawal of said collet-holding fingers.

17. A well packer according to claim 15, including a main link carrying said collet-holding fingers, means for attaching a main lifting line to said main link, means pivotably connecting said first mentioned cam to said main link, an actuating link having first and second ends, means articulating said cam plate to said first end of said actuating link, and means articulating said second end of said actuating link to said first mentioned cam whereby rotation of said drive cam effects relative translational movement between said main link and said actuating link and consequent rotation of said first mentioned cam.

18. A well packer according to any one of claims 2 to 9 wherein at least one of (a) said tapered internal surface portion of the collet means and (b) the tapered external surface of the packer sleeve means is rough-machined with a helical thread whereby rotation of said packer sleeve means with respect to said collet means in one direction will cause movement of said packer sleeve means with respect to said collet means in a direction tending to bring the tapered external surface of the packer sleeve means more firmly into engagement with the tapered internal surface of the collet means.

19. A well packer according to any one of claims 2 to 9, wherein the taper of said external surface of the packer sleeve means is the same as that of the internal surface of the collet means.

20. A packer according to claim 19, wherein said taper is substantially 4°.

* * * * *